US005502742A

United States Patent [19]

Kellogg et al.

[11] Patent Number: 5,502,742

[45] Date of Patent: Mar. 26, 1996

[54] HEAT TREATING FURNACE WITH REMOVABLE FLOOR, ADJUSTABLE HEATING ELEMENT SUPPORT, AND THREADED CERAMIC GAS INJECTION NOZZLE

[75] Inventors: Charles Kellogg, Warrington; Charles Schmidt, Meadowbrook, both of Pa.

[73] Assignee: Abar Ipsen Industries, Inc., Bensalem, Pa.

[21] Appl. No.: 23,354

[22] Filed: Feb. 26, 1993

[51] Int. Cl.[6] ..... F27B 5/02; F27B 5/16

[52] U.S. Cl. ..... 373/128; 373/109; 373/113; 432/77; 432/206; 432/207; 239/597; 239/600

[58] Field of Search ..... 373/128–130, 373/109, 110, 112, 113; 219/390, 536; 432/77, 207, 206, 208; 239/597, 599, 600

[56] References Cited

U.S. PATENT DOCUMENTS

| | | | |
|---|---|---|---|
| 107,603 | 9/1870 | DuFaur | 239/597 |
| 487,628 | 12/1892 | Lockhart | 239/597 |
| 583,286 | 5/1897 | Von Frays et al. | 239/597 |
| 2,265,027 | 12/1941 | Davis | 432/206 |
| 2,978,189 | 4/1961 | Metz et al. | 239/597 |
| 3,565,410 | 2/1971 | Scherf . | |
| 3,737,553 | 6/1973 | Kreider et al. . | |
| 3,812,276 | 5/1974 | Cyrway, Jr. et al. . | |
| 4,171,126 | 10/1979 | Zahn et al. . | |
| 4,191,598 | 3/1980 | Conybear et al. . | |
| 4,259,538 | 3/1981 | Jones . | |
| 4,298,767 | 11/1981 | Takigawa | 373/128 |
| 4,321,415 | 3/1982 | Christian et al. . | |
| 4,395,832 | 8/1983 | Jones et al. . | |
| 4,425,660 | 1/1984 | Jones . | |
| 4,429,403 | 1/1984 | Hooper | 373/128 |
| 4,489,920 | 12/1984 | Jones | 266/283 |
| 4,559,631 | 12/1985 | Moller . | |
| 4,560,348 | 12/1985 | Moller et al. . | |
| 4,586,895 | 5/1986 | Battles | 110/263 |
| 4,612,651 | 9/1986 | Moller et al. . | |
| 4,755,137 | 7/1988 | Barbe et al. | 432/156 |
| 4,764,109 | 8/1988 | Meyers | 432/241 |
| 4,765,068 | 8/1988 | Ripley . | |
| 4,799,881 | 1/1989 | Grier et al. | 432/77 |
| 4,836,115 | 6/1989 | MacArthur | 110/234 |
| 4,856,022 | 8/1989 | Jones . | |
| 4,860,306 | 8/1989 | Gibb . | |
| 4,906,182 | 3/1990 | Moller . | |
| 5,282,221 | 1/1994 | Benedict et al. | 373/148 |

FOREIGN PATENT DOCUMENTS

| | | | |
|---|---|---|---|
| 788602 | 1/1958 | United Kingdom | 239/597 |

OTHER PUBLICATIONS

Drawing Entitled "Hot Zone Assembly" (Dwg. No. D–25354), Abar Corp.

*Primary Examiner*—John A. Jeffery
*Attorney, Agent, or Firm*—Dann, Dorfman, Herrell and Skillman

[57] ABSTRACT

A heat treating furnace has a hot zone enclosure with a substantially rectangular cross section. The floor of the hot zone enclosure is formed such that it is removable independently of the remainder of the hot zone enclosure. The heat treating furnace has a heating element with a novel support element that is readily mounted on and removed from the hot zone enclosure and which adjusts to accommodate a wide range of heating element thicknesses and insulation shield thicknesses. The electrically insulating components of the support element are formed to resist electrical shorting resulting from metallization and to resist cracking from thermally induced stress. The heat treating furnace further includes a cooling gas injection nozzle formed to reduce turbulence in the injected gas stream and to be readily attached to or removed from the hot zone enclosure. The gas injection nozzle is preferably formed of a ceramic material and is mounted in an opening in the hot zone enclosure by a very coarse, light-bulb-like, thread formed in the body of the gas nozzle.

31 Claims, 7 Drawing Sheets

HEAT TREATING FURNACE WITH REMOVABLE FLOOR, ADJUSTABLE HEATING ELEMENT SUPPORT, AND THREADED CERAMIC GAS INJECTION NOZZLE

FIELD OF THE INVENTION

This invention relates to heat treating furnaces, and in particular to an electric heat treating furnace having a unique combination of novel features that provide significantly improved operating and maintenance characteristics compared to known heat treating furnaces.

BACKGROUND OF THE INVENTION

Many of the known heat treating furnaces have a hot zone with a circular cross section. A circular cross section hot zone, however, unnecessarily limits the maximum size workpiece load that the heat treating furnace can accommodate. During operation of the known heat treating furnaces, workpieces, furnace components, or in the case of a brazing furnace, the brazing alloy, can drop onto the hot zone floor causing damage thereto. Hitherto, the hot zone enclosure had to be removed in entirety from the furnace pressure vessel in order to repair or replace the hot zone floor. Such a laborious process leaves much to be desired.

There are several known designs for electric heating elements and their associated supports used in electric heat treating furnaces. A problem with the known designs is that they are prone to shorting out because the surfaces of the electrically insulated components of the heating element supports are progressively metallized during heat treating cycles.

Many of the known heating element supports include a stand-off or support shaft that threads into the hot zone enclosure. Such a heating element support is subject to distortion and galling from thermal cycling in the furnace. This distortion and galling causes the threaded portion of the stand-off to seize, which makes the heating element support very difficult to remove.

Another drawback of the known heating element supports is that they must be specifically designed for either graphite or metal heating elements. A graphite heating element is significantly thicker than a metal heating element. Furthermore, the known heating element supports must also be uniquely designed to accommodate different types and/or thicknesses of heat shielding or insulation that is used to line the furnace hot zone enclosure. Still further, the known heating element supports provide little, if any, adjustability for controlling the distance of the heating element from the heat shield.

Gas injection nozzles are used in heat treating furnaces to distribute a cooling gas over the workpiece load during the cooling portion of a heat treating cycle. The known designs for gas injection nozzles include a tube having flared ends which is formed of rolled molybdenum sheet metal. Such a design is disclosed in U.S. Pat. No. 4,560,348, assigned to Abar Ipsen Industries, Inc., the assignee of the present application. Another design employs a threaded graphite tube as described in U.S. Pat. No. 4,765,068. The sheet metal tube design can easily become dislodged during operation of the heat treating furnace. Furthermore, such a nozzle becomes brittle after exposure to several heat treating cycles. The threaded graphite tube has limited utility because it can contaminate the workpieces with carbon during some heat treating processes.

In view of the foregoing, it would be very desirable to have an electric heat treating furnace which overcomes the disadvantages of the known heat treating furnaces.

SUMMARY OF THE INVENTION

In accordance with one aspect of the present invention there is provided a heat treating furnace, preferably a vacuum heat treating furnace, which includes a pressure vessel, a door disposed at one end thereof for accessing the interior of the pressure vessel, and an enclosure mounted in the pressure vessel and defining a hot zone therein. The hot zone enclosure includes a front wall, a back wall, a pair of sidewalls, a top wall, and a floor and has a substantially rectangular cross section when viewed from the door end of the furnace. The floor is formed separately from the walls and is mounted in the pressure vessel so as to be removable therefrom independently of the hot zone enclosure.

In accordance with another aspect of the present invention there is provided an electric heat treating furnace which includes a novel support for the electric heating elements therein. The electric heat treating furnace also has a hot zone enclosure and the heating element support includes means for mounting the support inside the hot zone on the internal enclosure in such a way that it is not subject to seizing and is, therefore, readily removable after several heat treating cycles. The heating element support also includes a support shaft having a first end attached to the mounting means and a second end extending into the hot zone. An electrically insulated connector is mounted on the second end of the shaft for attachment to the heating element. The insulated connector includes a base portion formed for resisting cracking from thermally induced stress and electrical short circuits that result from metallization. The insulated connector also includes a support portion that extends from the base portion for insertion into an opening in the electric heating element whereby the insulated connector engages with the electric heating element. The heating element support further includes a fastener formed for attaching to the support portion of the insulated connector in order to secure the electric heating element to the insulated connector.

In accordance with a further aspect of the present invention there is provided a heat treating furnace having a novel gas injection nozzle. The gas injection nozzle according to the present invention has a cylindrical wall that defines a gas flow channel having an inlet and an outlet at respective ends of the cylindrical wall. A first flare is formed in the cylindrical wall at the inlet end and a second flare is formed in the cylindrical wall at the outlet end. Together the first and second flares prevent turbulence in the flowing gas. The gas injection nozzle according to the present invention is preferably formed of a ceramic material and includes attachment means formed in the cylindrical wall adjacent the inlet end for attaching the gas injection nozzle in an opening in the hot zone enclosure of the heat treating furnace. In a preferred embodiment the gas injection nozzle of this invention has a collar formed around the circumference of the cylindrical wall between the attachment means and the outlet end for holding the heat shield in place.

BRIEF DESCRIPTION OF THE DRAWINGS

The foregoing summary as well as the following detailed description of a preferred embodiment of the present invention will be better understood when read in conjunction with the appended drawings in which.

DETAILED DESCRIPTION

Figure 1:
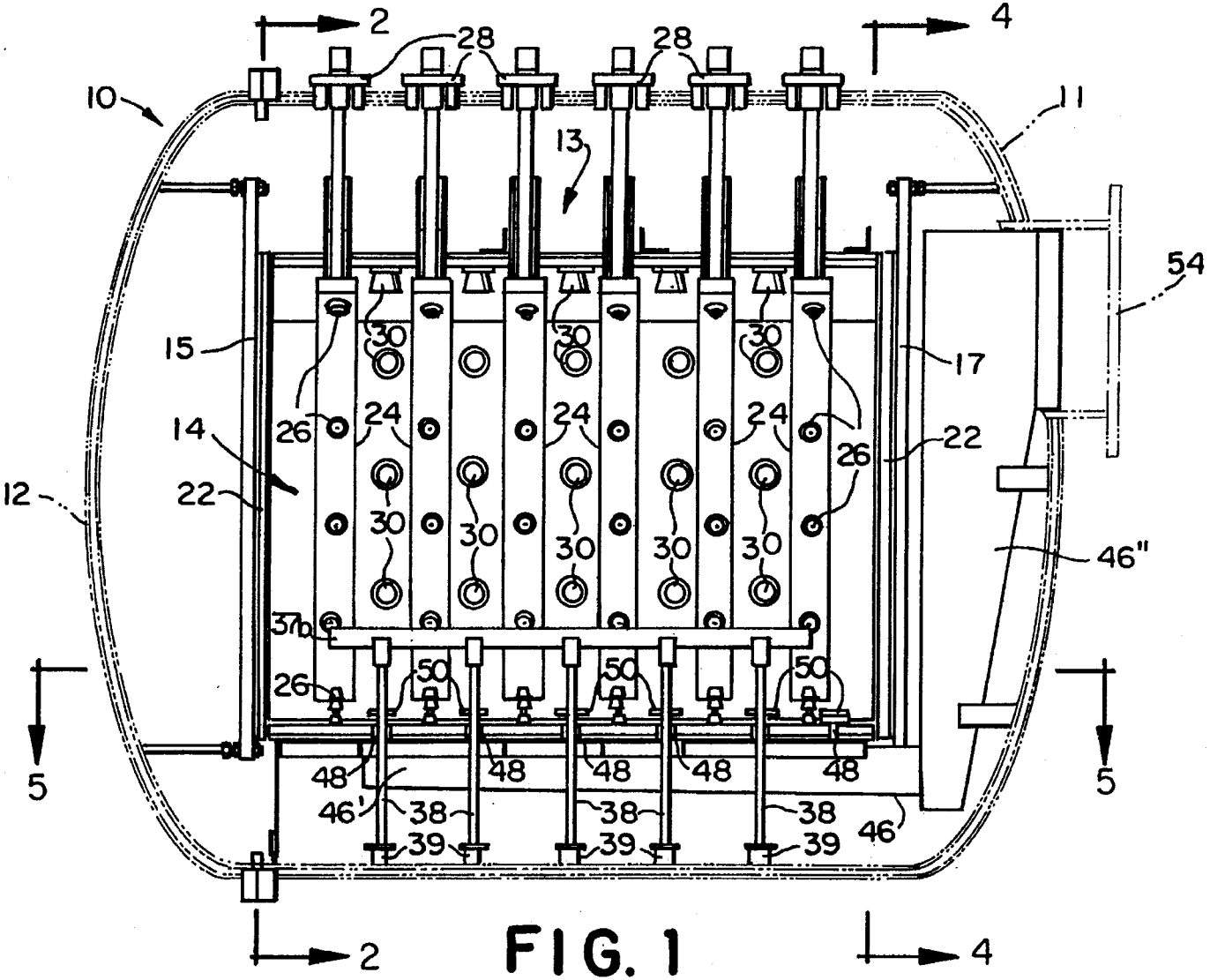
FIG. 1 is a side elevation view of the interior of a heat treating furnace in accordance with the present invention.
Figure 2:
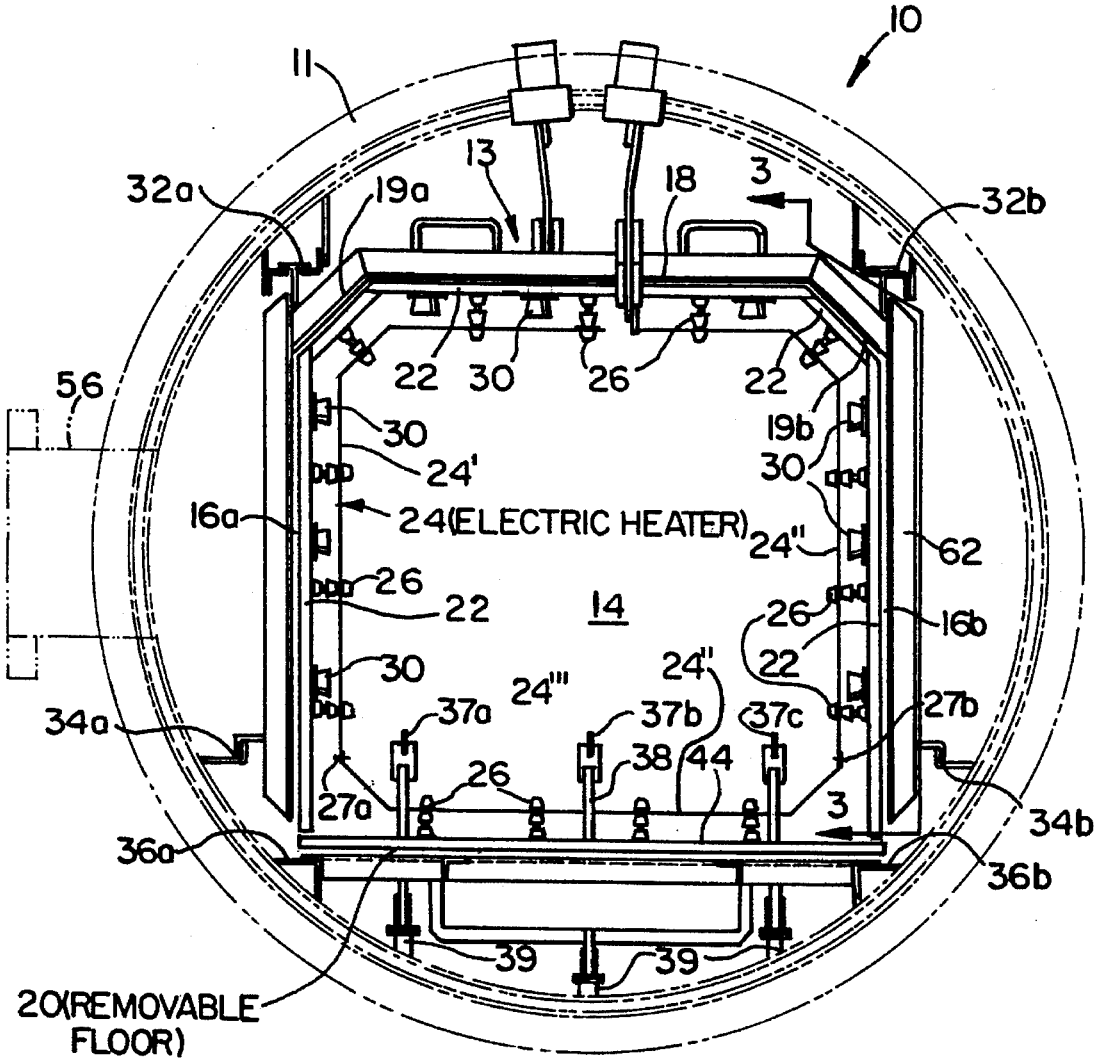
FIG. 2 is an end elevation view of the heat treating furnace of FIG. 1 as viewed along line 2—2 of FIG. 1.

Referring now to the drawings wherein like reference numerals refer to the same or similar components across the several views and, in particular, to FIGS. 1 and 2, there is shown an electric heat treating furnace 10 in accordance with the present invention. The electric heat treating furnace 10 includes a pressure vessel 11 having a door 12 at one end thereof. An enclosure 13 mounted inside the pressure vessel 11 defines a hot zone 14 wherein a workpiece load is placed for a heat treating cycle.

The enclosure 13 has a front wall 15, a pair of side walls **16*a* and 16*b*, a back wall 17, a top wall 18, and a floor 20. The front wall 15, sidewalls 16*a* and 16*b*, back wall 17, and top wall 18 are preferably formed from stainless steel sheet. The walls are covered with a heat insulating shield 22** preferably formed of a graphite composite material.

An electric heating element 24 is disposed inside the hot zone enclosure 13. Preferably, the electric heating element 24 has three sections: a first L-shaped section 24', a second L-shaped section 24", and a bottom section 24'". As shown in FIG. 2, the bottom section 24'" is substantially parallel to the floor 20, whereas the long legs of the L-shaped sections 24' and 24" are substantially parallel to the walls **16*a* and 16*b***, respectively.

The electric heating element 24 is supported on the enclosure walls and floor by a plurality of heating element supports 26. The bottom portion 24'" is electrically connected to the L-shaped portions 24' and 24" by means of fasteners **27*a* and 27*b* to form a continuous element. In this manner, the bottom portion 24'" of heating element 24 can be disconnected from the L-shaped portions 24' and 24". Electric power terminals 28 are provided to connect the heating element 24** to an external source of electrical energy (not shown).

The arrangement of the side walls **16*a* and 16*b*, top wall 18, floor 20, and heating element 24 of the hot zone enclosure 13 provides an opening having a substantially rectangular cross section. Such a configuration can accommodate a workpiece load having a larger cross section than can a known, circular cross section hot zone. In the embodiment shown, the top wall 18 includes angled portions 19*a* and 19*b* each of which extends downward at an angle to intersect with the sidewall 16*a* or 16*b***. This preferred arrangement provides a hot zone with a polygonal cross section which can accommodate a workpiece load having a higher profile than can a simple rectangular cross section hot zone.

A plurality of gas injection nozzles 30 are mounted in the sidewalls **16*a* and 16*b* and the top wall 18 of hot zone enclosure 13. These nozzles 30 direct streams of an inert cooling gas onto a workpiece load during the cooling portion of a heat treating cycle. The cooling gas enters the pressure vessel 11 through a gas intake port 56, flows through the annular region of the pressure vessel 11 outside the hot zone enclosure 13, and into the hot zone 14 through the gas nozzles 30. The cooling gas exits the hot zone 14 through an exhaust duct 46 having a detachable portion 46' and a fixed portion 46"**. This arrangement obviates the need for a separate plenum surrounding the hot zone enclosure.

The upper assembly of hot zone enclosure 13, which includes the sidewalls **16*a* and 16*b* and the top wall 18, is mounted in the pressure vessel 11 by means of hanger support assemblies 32*a* and 32*b* suspended from the upper portion of pressure vessel 11. A pair of lower supports 34*a* and 34*b* provide additional support and lateral stability for the hot zone enclosure 13 in the pressure vessel 11**.

Figure 3:
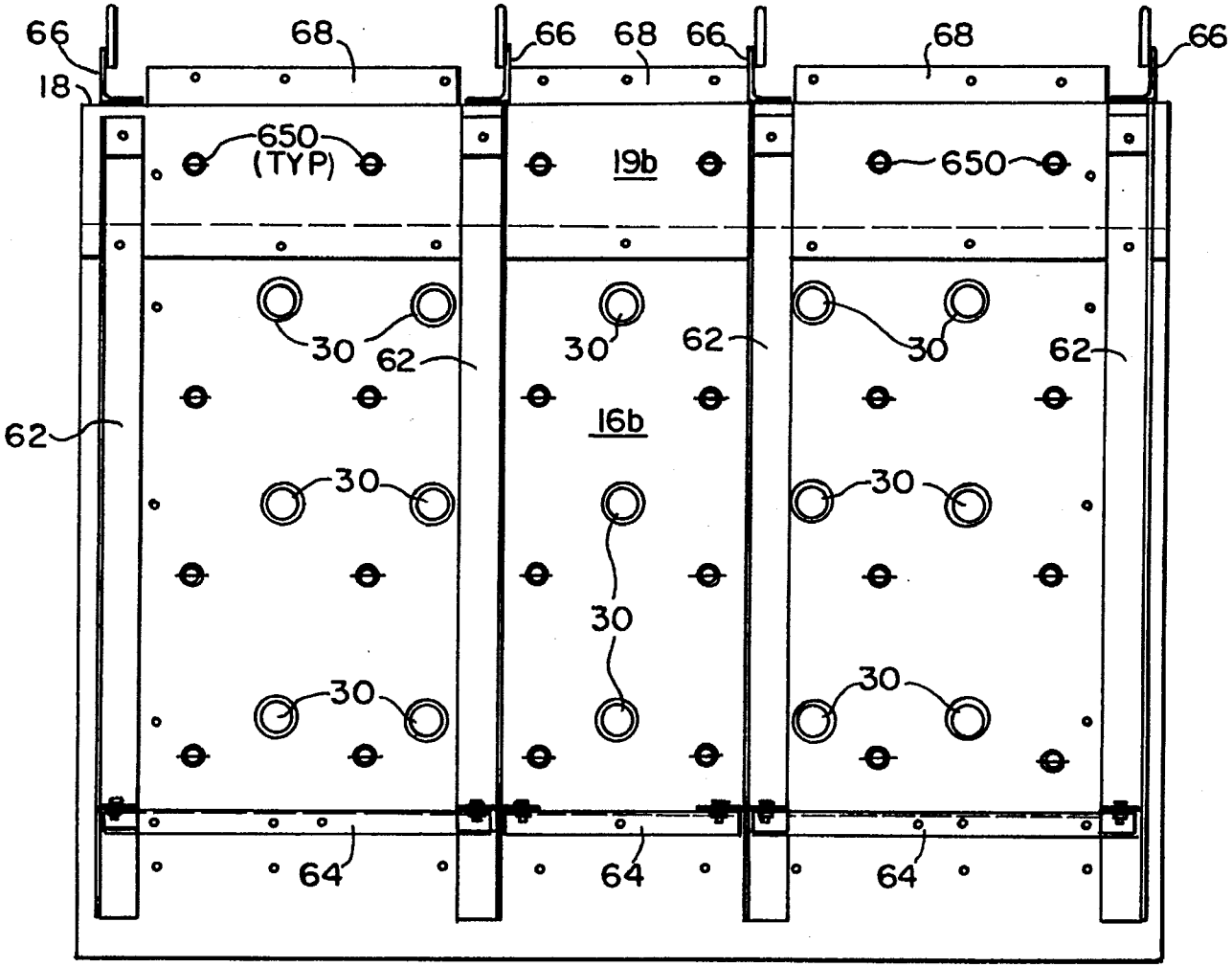
FIG. 3 is a side elevation view of the hot zone enclosure of the heat treating furnace of FIG. 2 as viewed along line 3—3 in FIG. 2.

The upper assembly of hot zone enclosure 13 is preferably constructed as a unit which is suspended in the pressure vessel 11 by means of the hanger support assemblies **32*a* and 32*b* and the lower supports 34*a* and 34*b*. FIG. 3 illustrates the construction of hot zone enclosure 13 as viewed along line 3—3 in FIG. 2. Side wall 16*b* is fastened to the top wall 18 along the lower edge of angled portion 19*b*. The upper assembly of enclosure 13 includes a framework for supporting the stainless steel backing members. This framework includes a plurality of vertical support members 62 which are cross-braced with a plurality of horizontal support members 64 near the lower end of sidewall 16*b*. A series of cross members 66 are fastened to top wall 18 at spaced intervals aligned with the vertical support members 62 to provide rigidity to the stainless steel backing members. Longitudinally oriented stiffening members 68 are also fastened to top wall 18 between the respective cross members 66 for additional rigidity. The framework formed by the respective members 62, 64, 66 and 68, has an inverted U-shape in end aspect. The framework rigidifies the side walls and top wall of the hot zone enclosure 13** so that the upper assembly can be installed in the pressure vessel and removed therefrom as a unit.

Figure 4:
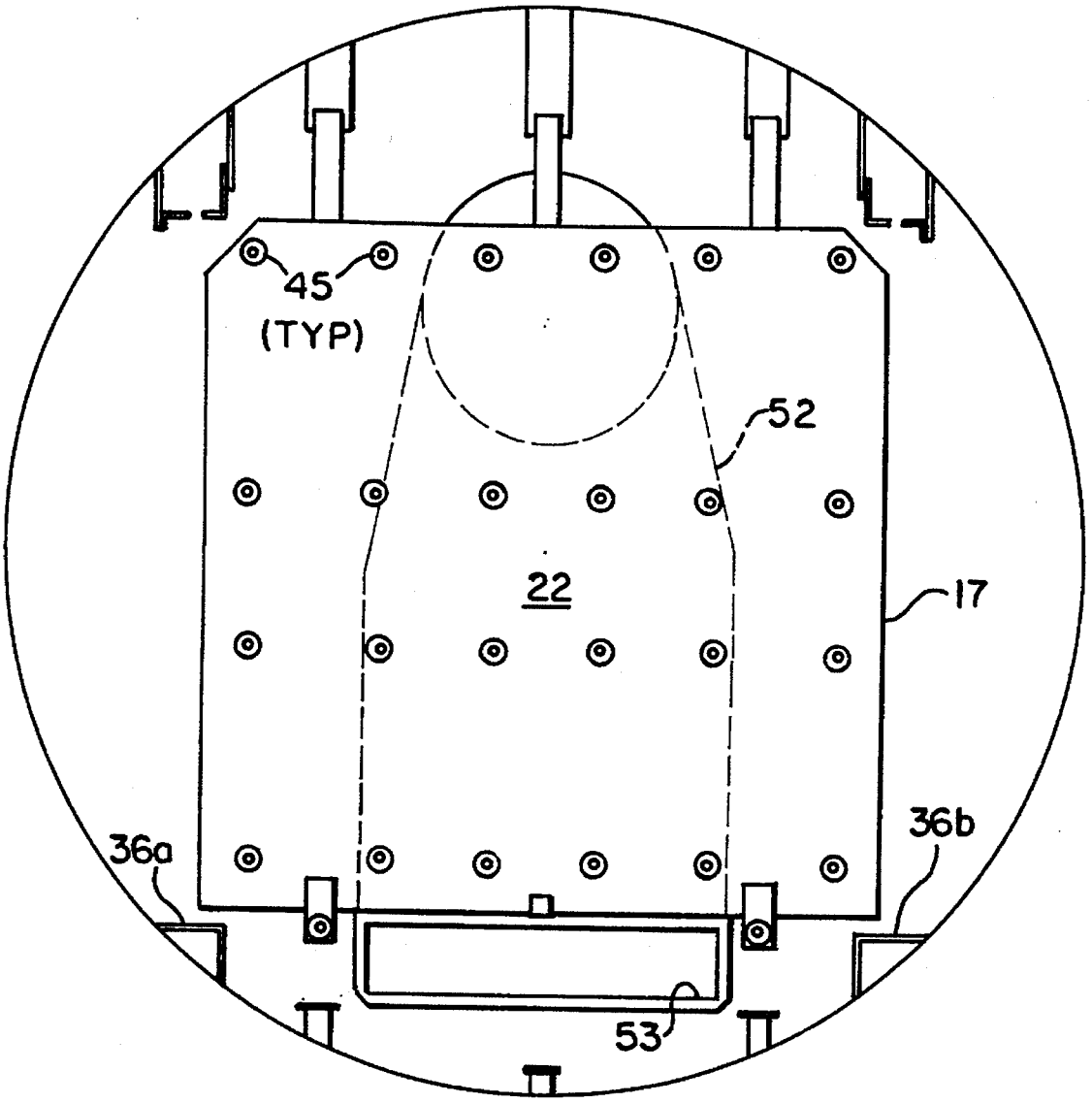
FIG. 4 is an elevation view of the back wall of the heat treating furnace of FIG. 1 as viewed along line 4—4 in FIG. 1.

The front wall 15 is supported from the door 12 so as to be moveable therewith relative to the hot zone enclosure 13. The back wall 17 is supported in the back end of the pressure vessel 11 independently of the remainder of enclosure 13. As shown in FIG. 4, the back wall 17 is suspended between the hot zone 14 and the fixed portion 46" of the cooling gas exhaust duct 46. FIG. 4 also illustrates the manner in which the heat insulating shield 22 is mounted on back wall 17. A plurality of button-type, hold-down fasteners 45 protrude through the insulating shield and are anchored to the back wall 15 with a threaded stud or a bolt. This method of mounting the heat insulating shield is typical for the other walls and for the floor of enclosure 13.

Referring again to FIGS. 1 and 2, the floor 20 of the hot zone enclosure 13 is constructed separately from the upper portion of hot zone enclosure 13 and is independently supported in the pressure vessel 11 by means of floor supports 36*a* and 36*b* mounted on a lower portion of the pressure vessel 11. Because of this arrangement, the floor 20 can be removed independently of the upper portion of hot zone enclosure 13. A set of work-load supports comprising runners 37*a*, 37*b* and 37*c* are mounted in the pressure vessel in a known manner. A plurality of support rods 38 extend from a like plurality of support bases 39 in the floor of the pressure vessel through the hot zone floor 20 to support the runners 37*a*, 37*b* and 37*c*.

Figure 5:
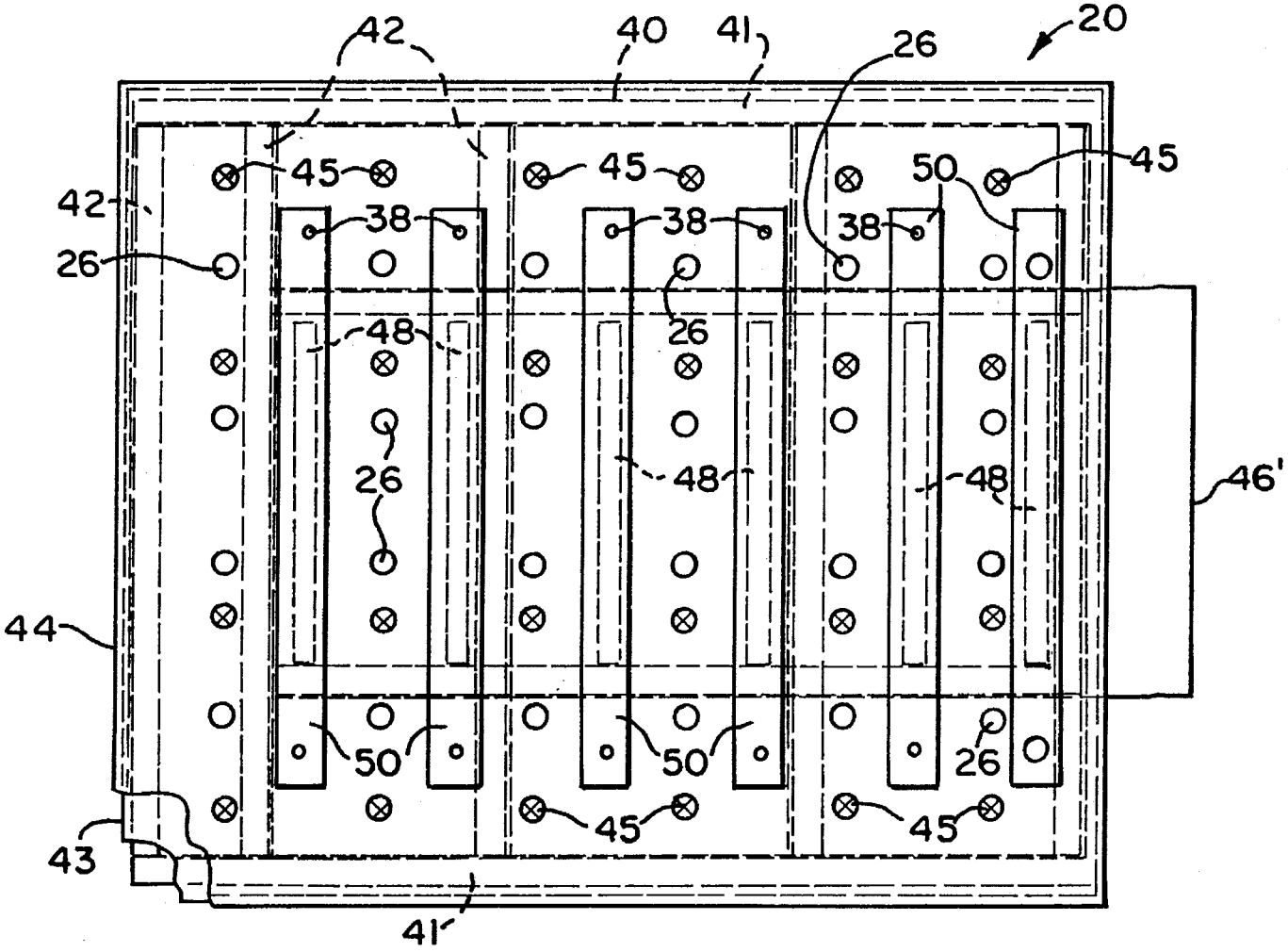
FIG. 5 is a plan view of the floor of the hot zone of the heat treating furnace of FIG. 1 as viewed along line 5—5 of FIG. 1.

Referring now to FIG. 5, there is shown a preferred construction for the floor 20 of the hot zone enclosure 13, in accordance with the present invention. The floor 20 includes a rigid frame 40 constructed of side beams 41 and a plurality of cross beams 42 affixed between the side beams 41 at spaced intervals. A backing member 43 is affixed to the frame 40 in any known manner. The backing member 43 is preferably formed of stainless steel sheet, similar to the side walls and top wall of hot zone enclosure 13. An insulating shield 44 is affixed to the backing member 43 by a plurality of hold down buttons 45.

The detachable portion 46' of exhaust duct 46 is attached to the underside of the floor 20 in a known manner. A plurality of elongated slots 48 are formed through the backing member 43 and insulating shield 44 of floor 20, to provide outlets for the cooling gas from the hot zone 14 to the gas exhaust duct 46. Slot covers 50 are mounted on the work piece support rods 38, a small distance above the surface of floor 20, as shown in FIG. 1, to prevent excess heat radiation from the hot zone and to prevent debris from falling through or blocking the slots 48.

Referring still to FIG. 1, the detachable portion 46' of the exhaust duct 46 has an end which extends beyond the length of floor 20 and which is formed for insertion into an opening 53 in the fixed portion of exhaust duct 52. The opening 53 is shown more clearly in FIG. 4. The fixed portion 46" of the gas exhaust duct 46 communicates with an exhaust port 54 formed in the back end of pressure vessel 11.

Figure 7:
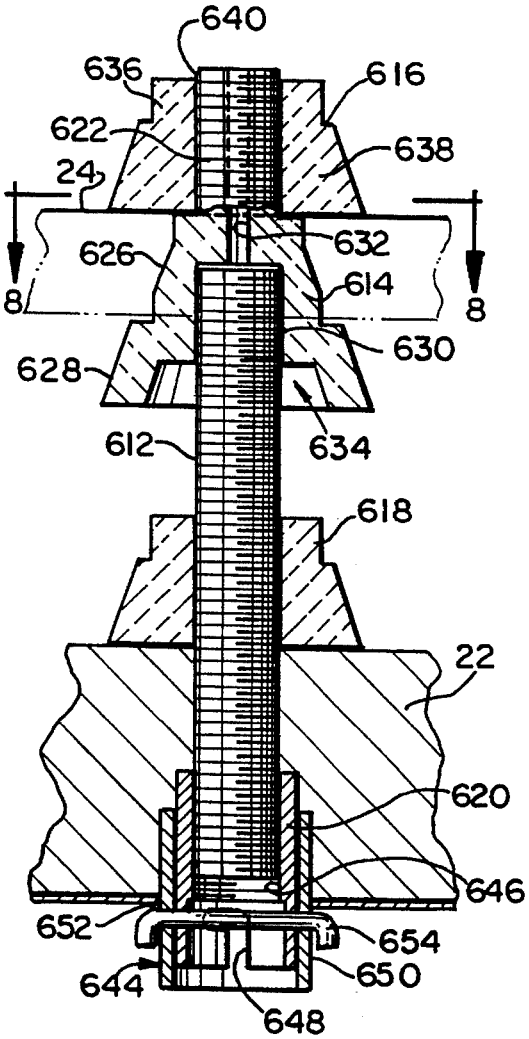
FIG. 7 is an elevation view in section of the electric heating element support shown in FIG. 6.
Figure 6:
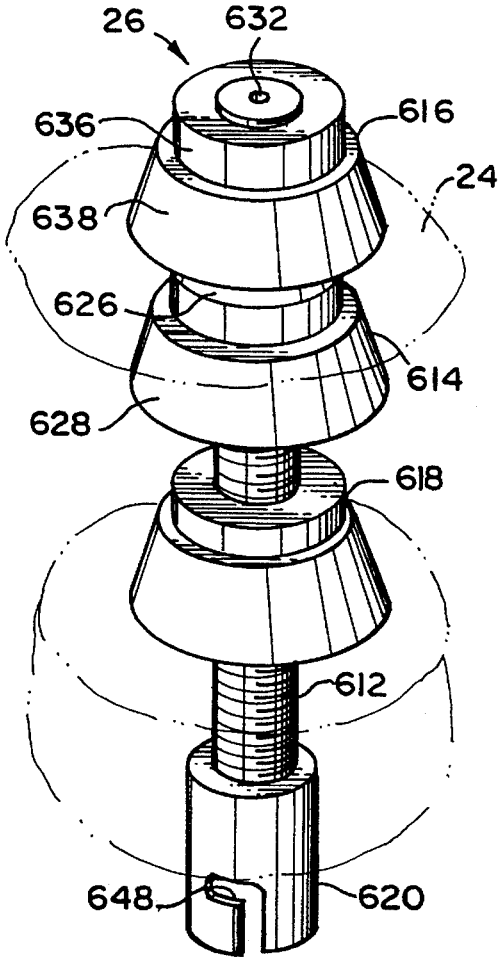
FIG. 6 is a perspective view of an insulating support for an electric heating element used in an electric heat treating furnace according to the present invention.

Referring now to FIGS. 6 and 7, there is shown a preferred arrangement for a heating element support 26 used in a furnace according to the present invention. A threaded shaft 612 has an insulated connector 614 mounted on one end thereof which is formed to engage with the heating element 24. A first insulated fastener 616 attaches to the insulated connector 614 for securing the electric heating element 24 thereto. It will be appreciated readily that this arrangement permits adjustment to accommodate a wide variety of heating element thicknesses. A second insulated fastener 618 is movably mounted on shaft 612 for retaining the insulating shield 22 in place. It will also be appreciated that this arrangement provides adjustability to accommodate a wide range of shield thicknesses. A locking element 620 is attached to the other end of shaft 612 for removably mounting the support element 26 inside the hot zone 14 on a wall of enclosure 13. The insulated connector 614 and the first and second insulated fasteners 616 and 618 are preferably formed of ceramic material. The preferred material for the insulated connector is A9648 alumina and the preferred material for the insulated fasteners is MUL-6 mullite. Ceramic-coated metal parts can also be used. If desired, the fasteners can be formed of a heat resistant metal such as molybdenum.

The insulated connector 614 has a support portion that includes a threaded stud 622 and a neck portion 626. The threaded stud 622 is formed to extend through an opening in the heating element 624. The neck portion 626 provides additional length in the support portion to accommodate a graphite heating element, which is considerably thicker than a metal heating element. The insulated connector 614 also has a base portion that includes a conical portion 628. The conical portion 628 dissipates heat more evenly than other configurations and thus provides excellent resistance to cracking that results from thermally induced stress in the insulated connector 614.

A threaded receptacle 630 is formed in the insulated connector 614 for receiving the end of threaded shaft 612. An exhaust hole 632 is formed through the support portion of insulated connector 614 to facilitate the removal of gases from the interior of insulated connector 614 when a vacuum is drawn in the pressure vessel 11 during a heat treating cycle. An antimetallization cavity 634 is formed in the base portion of insulated connector 614. The antimetallization cavity 634 inhibits metallization of the base portion of insulated connector 614 thereby preventing short circuits and extending the useful life of the insulated connector 614.

Figure 8:
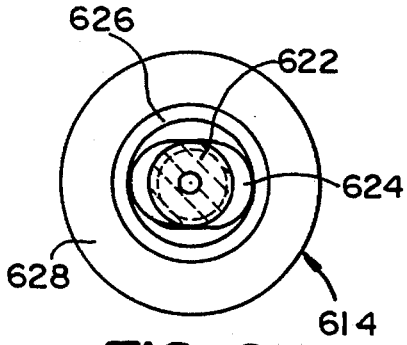
FIG. 8 is a partial section view of the heating element shown in FIG. 7 as viewed along line 8—8 in FIG. 7.

Referring now to FIG. 8, in addition to FIGS. 6 and 7, a non-circular shoulder 624 is formed between the neck portion 626 and the threaded shaft 622 of the insulated connector 614. The shape of the shoulder 624 is selected to mate with a similarly shaped opening in the heating element 24. In the embodiment shown, the shoulder 624 is oval in shape. In this manner, rotation of the insulated connector 614 relative to the heating element 24 is restricted. The first insulated fastener 616 includes a cylindrical portion 636 and a conical portion 638. This construction provides good resistance to cracking from thermally induced stress which could damage the fastener during a heat treating cycle. A threaded bore is formed centrally in the insulated fastener 616 for receiving the threaded shaft 622 such that the fastener 616 can be rotated to secure heating element 24 on insulated connector 614. The second insulated fastener 618 is formed identically to the first insulated fastener 616. If desired, metal washers (not shown), preferably of molybdenum, are used with the insulated connector 614 and the fastener 616. The metal washers are disposed between the connector 614 and the fastener 616 on opposite sides of the heating element 24 to prevent slippage and to inhibit galling of the heating element 24.

The locking element 620 is formed of a tubular member 644 having a plurality of internal threads 646 formed therein, at least along a portion of the length of tubular member 644. A pair of L-shaped slots 648 are formed in the end of tubular member 620 away from the internal threads 646. A receptacle 650 which is preferably a second tubular member having an inside diameter dimensioned to receive the locking element 620 has a retaining wire or pin 654 disposed diametrically therethrough. When locking member 620 is inserted into the receptacle 650, the slots 648 engage with the retaining wire 654. When the locking element 620 is rotated about ¼ turn, the locking element 620 becomes restrained against removal from the receptacle 650. The receptacle 650 is affixed in an opening in a wall of the hot zone enclosure 13 in a known manner, such as by welding. The shaft 612 and retaining wire 654 are preferably formed of a heat resistant metal such as molybdenum. The locking member 620 and receptacle 650 are preferably formed of a carbon steel or stainless steel.

Figure 10:
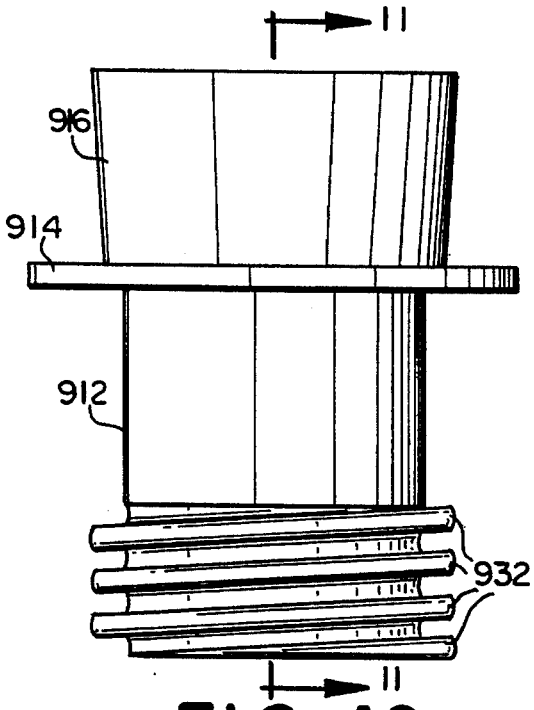
FIG. 10 is a side elevation view of the gas injection nozzle shown in FIG. 9.
Figure 9:
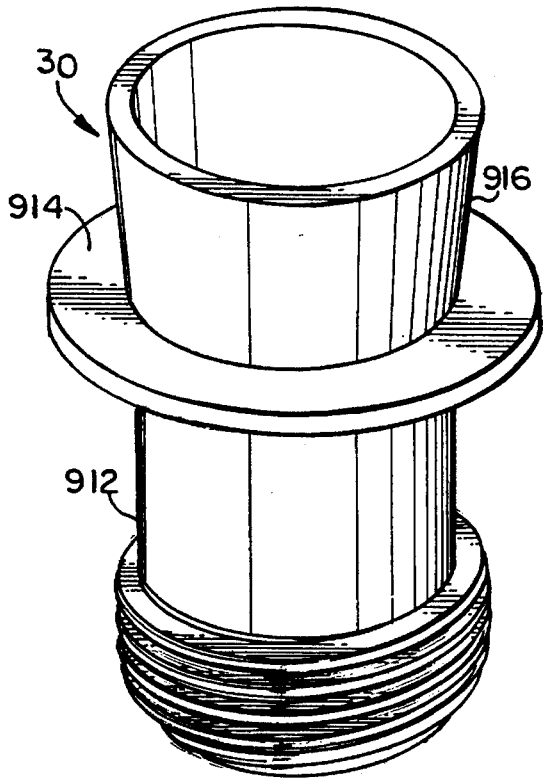
FIG. 9 is a perspective view of a gas injection nozzle for a heat treating furnace according to the present invention.
Figure 11:
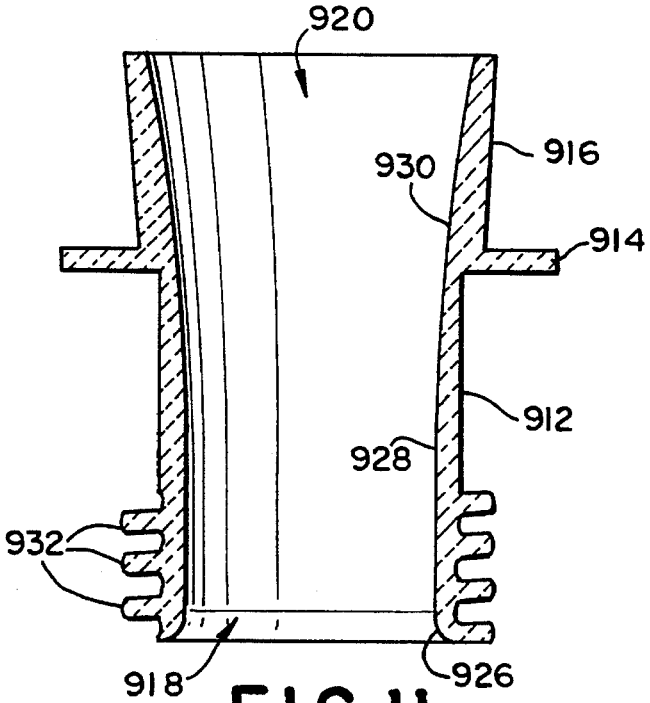
FIG. 11 is a side elevation view in section of the gas injection nozzle of FIG. 10 as viewed along line 11—11 in FIG. 10.

Referring now to FIGS. 9, 10 and 11, there is shown a preferred embodiment of a gas injection nozzle for use in a heat treating furnace according to the present invention. The gas injection nozzle 30 includes a cylindrical wall 912 which defines a gas flow channel between an inlet 918 and an outlet 920. A first flare 926 is formed in the cylindrical wall 912 at the inlet end and a second flare 930 is formed in the cylindrical wall at the outlet end of nozzle 30. A plurality of course threads 932 are formed in the cylindrical wall adjacent to the inlet end. The threads 932 are preferably as coarse as light-bulb threads and provide a convenient means of attaching the gas injection nozzle 30 in an opening in a wall of the hot zone enclosure 13. Such coarse threading significantly reduces the risk of seizing.

As shown in FIG. 11, the radius of curvature of first flare 926 is substantially shorter compared to the curvature radius of the second flare 930. In the preferred arrangement, the gas flow channel is venturi-like in shape to limit turbulence in and provide substantially laminar flow of the cooling gas through the gas injection nozzle 30.

In the preferred embodiment as shown in FIGS. 9, 10 and 11, the gas injection nozzle 30 also has a collar 914 formed circumferentially about the cylindrical wall 912 intermediate the inlet 918 and outlet 920. Collar 914 functions to retain the heat insulating shield 22 in place. Also in the preferred embodiment shown, the gas injection nozzle 30 has a conical wall portion 916 formed between the collar 914 and the outlet 920. The conical wall portion 916 facilitates formation of the second flare 930 and provides resistance to cracking from thermally induced stress during a heat treating cycle. The gas injection nozzle 30 is preferably formed of a ceramic material, such as MUL-6 mullite. The thickness of the cylindrical wall 912 is selected to provide resistance to cracking from thermally induced stresses.

It will be recognized by those skilled in the art that changes or modifications may be made to the above-described invention without departing from the broad inventive concepts of this invention. It is understood therefore that the invention is not limited to the particular embodiments disclosed herein, but is intended to cover all modifications and changes which are within the scope of the invention as defined in the appended claims.

What is claimed is:

1. A hot zone enclosure for a heat treating furnace comprising:

a front wall;

a back wall;

an upper assembly including a pair of side walls and a top wall that are assembled for handling as a unit;

a floor that is formed separately from said upper assembly and for independent movement relative thereto; and an exhaust duct that is affixed to the exterior of the hot zone enclosure so as to be removable with the hot zone enclosure from the heat treating furnace;

said hot zone enclosure having a substantially rectangular cross section.

2. A hot zone enclosure as recited in claim 1 wherein said top wall comprises a central portion that is substantially parallel to said floor, a second portion that extends downward at an angle from said central portion to intersect with one of said side walls, and a third portion that extends downward at an angle from said central portion to intersect with the other of said side walls, whereby said enclosure has a polygonal cross-section.

3. A hot zone enclosure as recited in claim 1 wherein said upper assembly comprises:

an inverted U-shaped frame formed from a first plurality of interconnected structural members; and a plurality of wall backing members attached to said first plurality of interconnected structural members so as to form substantially planar surfaces for the side walls and the top wall of the hot zone enclosure.

4. A hot zone enclosure as recited in claim 3 further comprising a heat insulating shield attached to said plurality of backing members a support portion extending from said base portion for engagement with the electric heating element; and a fastener formed for attaching to the support portion of said insulated connector for securing the electric heating element to said insulated connector.

5. A heat treating furnace comprising:

a pressure vessel having an interior;

a door disposed at one end of said pressure vessel for accessing the interior thereof;

an enclosure disposed in said pressure vessel, said enclosure defining a hot zone therein, said enclosure including a front wall, a back wall, a pair of side walls, a top wall, and a floor, said floor being mounted in said pressure vessel so as to be removable from said pressure vessel independently of the walls of said enclosure, said walls and said floor being planar and said enclosure having a substantially rectangular cross-section when viewed from the door end of said pressure vessel, an electric heating element disposed in said hot zone; and a plurality of support insulators mounted on said enclosure for supporting said electric heating element on the floor, side walls, and top wall of said enclosure;

said electric heating element including:

a first portion substantially parallel to the floor of said enclosure;

a second portion substantially parallel to one of the side walls of said enclosure; and removable fasteners for connecting said first portion to said second portion, whereby said first portion can be removed with said floor.

6. A heat treating furnace as recited in claim 5 wherein said top wall comprises a central portion that is substantially parallel to said floor, a second portion that extends downward at an angle from said central portion to intersect with one of said side walls, and a third portion that extends downward at an angle from said central portion to intersect with the other of said side walls, whereby said enclosure has a hexagonal cross-section.

7. A heat treating furnace as recited in claim 5 comprising an exhaust duct for conducting a cooling gas from the hot zone, said exhaust duct comprising a first duct portion that is fixedly mounted in said pressure vessel and a second duct portion that is detachable from said first duct portion and affixed externally to the hot zone enclosure.

8. A heat treating furnace as recited in claim 7 comprising injection means for injecting a quenching gas into the hot zone and an opening for providing a flow path between the hot zone and said second exhaust duct portion, whereby an injected quenching gas can exit the hot zone.

9. A heat treating furnace as recited in claim 8 wherein said injection means comprises a gas injection nozzle mounted on a wall of said enclosure, said gas injection nozzle including:

a cylindrical wall defining a gas flow channel having an inlet and an outlet at respective ends of said cylindrical wall;

a first flare formed in said cylindrical wall at the inlet end and a second flare formed in said cylindrical wall at the outlet end; and attachment means formed on said cylindrical wall adjacent said inlet end for attaching the gas injection nozzle in an opening in the internal enclosure of the heat treating furnace, whereby said gas injection nozzle is mounted on said enclosure.

10. A heat treating furnace as recited in claim 9 wherein said injection means comprises a plurality of said gas injection nozzles mounted in the side walls and the top wall of said enclosure.

11. A heat treating furnace as recited in claim 5 wherein each of said plurality of support insulators comprises:

mounting means for mounting the support insulator on said enclosure;

a support shaft having a first end attached to said mounting means and a second end extending into the hot zone;

an electrically insulated connector mounted on the second end of said shaft, said insulated connector including:

a base portion formed for resisting metallization and thermally induced stress, said base portion including attachment means for attaching said insulated connector to the second end of said support shaft; and a support portion extending from said base portion for engagement with the electric heating element; and a fastener formed for attaching to the support portion of said insulated connector for securing the electric heating element to said insulated connector.

12. A heat treating furnace as recited in claim 5 wherein said front wall, said back wall, said side walls, said top wall, and said floor each comprises:

a backing member; and a heat shield affixed to said backing member so as to inhibit the radiation of heat from the hot zone during operation of the heat treating furnace.

13. A heat treating furnace as recited in claim 5 wherein each of the side walls and the top wall of said enclosure comprises:

a first frame formed of a plurality of rigid structural members;

a backing member attached to said first frame; and a heat shield affixed to said backing member so as to inhibit the radiation of heat from the hot zone during operation of the heat treating furnace.

14. A heat treating furnace as recited in claim 13 wherein the floor of said enclosure comprises:

a second frame formed of a plurality of rigid structural members;

a floor-backing member attached to said second frame; and a floor heat shield affixed to said floor-backing member so as to inhibit the radiation of heat from the hot zone during operation of the heat treating furnace.

15. A heat treating furnace comprising:

a pressure vessel;

a door disposed at one end of said pressure vessel for accessing the interior thereof;

an enclosure disposed in said pressure vessel, said enclosure defining a hot zone therein, said enclosure including a front wall, a back wall, a pair of side walls, a top wall, and a floor, said floor being mounted in said pressure vessel so as to be removable from said pressure vessel independently of the walls of said enclosure;

injection means for injecting a quenching gas into the hot zone;

an exhaust duct for conducting the quenching gas from the hot zone such that the quenching gas can be exhausted from the heat treating furnace;

an electric heating element disposed in said hot zone; and a plurality of support insulators mounted on said enclosure for supporting said electric heating element on the floor, side walls, and top wall of said enclosure;

said electric heating element including:

a first portion substantially parallel to the floor of said enclosure;

a second portion substantially parallel to one of the side walls of said enclosure;

a third portion substantially to the other of the side walls of said enclosure; and removable fasteners for connecting said first portion to said second and third portions, whereby said first portion can be removed with the floor of said enclosure.

16. A support for an electric heating element in an electric heat treating furnace of the type having an internal hot zone enclosure defining a hot zone, said support comprising:

mounting means for mounting the support on a hot zone enclosure;

a support shaft having a first end attached to said mounting means and a second end adapted to extend into a hot zone defined by the hot zone enclosure;

an electrically insulated connector mounted on the second end of said shaft, said insulated connector comprising:

a base portion formed for resisting thermally induced stress, said base portion including attachment means for attaching said insulated connector to the second end of said support shaft, said base portion having a cavity formed therein for inhibiting metallization of said base portion; and a support portion extending from said base portion for engagement with an electric heating element; and a fastener formed for attaching to the support portion of said insulated connector for securing the electric heating element to said insulated connector.

17. An electric heating element support as recited in claim 16 wherein the cavity formed in said base portion circumscribes the base portion attachment means.

18. An electric heating element support as recited in claim 16 wherein the support portion of said electrically insulated connector comprises a shaft portion formed to project through an opening in the electric heating element for engaging with said fastener.

19. An electric heating element support as recited in claim 18 wherein said insulated connector has a bore formed axially therethrough.

20. An electric heating element support as recited in claim 16 wherein said fastener is movably attached to said support portion of said insulated connector, whereby the electric heating element support can be adjusted to accommodate a variety of thicknesses of electric heating elements.

21. An electric heating element support as recited in claim 16 wherein said support portion comprises:

a shaft portion formed for projecting through an opening in the electric heating element for engaging with said fastener; and a neck portion formed between said base portion and said shaft portion, said neck portion having a transverse cross-section intermediate said base portion and said shaft portion for accommodating a graphite, electric heating element.

22. An electric heating element support as recited in claim 16 wherein said mounting means comprises:

a receptacle adapted to be mounted on the hot zone enclosure; and attachment means formed for insertion into said receptacle for engagement therewith.

23. An electric heating element support as recited in claim 22 further comprising a second fastener movably disposed on said shaft, intermediate said mounting means and said insulated connector, for retaining a heat insulating shield on the internal enclosure.

24. An electric heating element support as recited in claim 22 wherein said receptacle comprises a first tubular member having an inside diameter and a retaining pin spanning said inside diameter; and said attachment means comprises:

a second tubular member formed to fit inside said receptacle; and a pair of diametrically opposed slots formed in said second tubular member for engaging with said retaining pin whereby said second tubular member is retained in said receptacle.

25. An electric heating element support as recited in claim 16 wherein the support portion of said insulated connector comprises a non-circular shoulder formed thereon for engagement with an identically shaped opening in the electric heating element, whereby said insulated connector is prevented from rotating relative to the electric heating element.

26. A support for an electric heating element in an electric heat treating furnace of the type having an internal enclosure defining a hot zone, said support comprising:

mounting means for mounting the support on a hot zone enclosure;

a support shaft having a first end attached to said mounting means and a second end adapted to extend into a hot zone defined by the hot zone enclosure;

an electrically insulated connector mounted on the second end of said shaft, said insulated connector comprising:

a base portion formed for resisting thermally induced stress, said base portion including attachment means for attaching said insulated connector to the second end of said support shaft; and a support portion extending from said base portion for engagement with an electric heating element;

a fastener formed for attaching to the support portion of said insulated connector for securing the electric heating element to said insulated connector; and a second fastener movably disposed on said shaft, intermediate said mounting means and said insulated connector, for retaining a heat insulating shield on the hot zone enclosure.

27. A support for an electric heating element in an electric heat treating furnace of the type having an internal enclosure defining a hot zone, said support comprising:

(a) mounting means for mounting the support on a hot zone enclosure, said mounting means comprising:

(1) a receptacle adapted to be mounted on an internal enclosure of a vacuum furnace, said receptacle including a first tubular member having an inside diameter and a retaining pin spanning said inside diameter; and (2) attachment means formed for insertion into said receptacle for engagement therewith, said attachment means including a second tubular member formed to fit inside said receptacle and a pair of diametrically opposed slots formed in said second tubular member for engaging with said retaining pin whereby said second tubular member is retained in said receptacle;

(b) a support shaft having a first end attached to said mounting means and a second end adapted to extend into a hot zone defined by the hot zone enclosure;

(c) an electrically insulated connector mounted on the second end of said shaft, said insulated connector comprising:

(1) a base portion formed for resisting thermally induced stress, said base portion including attachment means for attaching said insulated connector to the second end of said support shaft; and (2) a support portion extending from said base portion for engagement with an electric heating element; and (d) a fastener formed for attaching to the support portion of said insulated connector for securing the electric heating element to said insulated connector.

28. A heat treating furnace comprising:

a pressure vessel having an interior;

a door disposed at one end of said pressure vessel for accessing the interior thereof;

an enclosure disposed in said pressure vessel, said enclosure defining a hot zone therein, said enclosure including a front wall, a back wall, a pair of side walls, a top wall, and a floor, said floor being mounted in said pressure vessel so as to be removable from said pressure vessel independently of the walls of said enclosure, said walls and said floor being planar and said enclosure having a substantially rectangular cross-section when viewed from the door end of said pressure vessel; and an exhaust duct for conducting cooling gas from the hot zone out of said pressure vessel, said exhaust duct comprising a first duct portion that is fixedly mounted in said pressure vessel and a second duct portion that is affixed to the floor and detachable from said first duct portion whereby said second duct portion is removable from the pressure vessel with the floor.

29. A heat treating furnace as recited in claim 28 comprising injection means for injecting a quenching gas into the hot zone and said floor includes an opening for providing a flow path between the hot zone and said second exhaust duct portion, whereby an injected quenching gas can exit the hot zone.

30. A heat treating furnace as recited in claim 29 wherein said injection means comprises a gas injection nozzle mounted on a wall of said enclosure, said gas injection nozzle including:

a cylindrical wall defining a gas flow channel having an inlet and an outlet at respective ends of said cylindrical wall;

a first flare formed in said cylindrical wall at the inlet end and a second flare formed in said cylindrical wall at the outlet end; and attachment means formed on said cylindrical wall adjacent said inlet end for attaching the gas injection nozzle in an opening in the internal enclosure of the heat treating furnace, whereby said gas injection nozzle is mounted on said enclosure.

31. A heat treating furnace as recited in claim 30 wherein said injection means comprises a plurality of said gas injection nozzles mounted in the side walls and the top wall of said enclosure.

* * * * *